US006119739A

United States Patent [19]

McGee et al.

[11] Patent Number: 6,119,739

[45] Date of Patent: Sep. 19, 2000

[54] EASY-FLOW FUNNEL

[76] Inventors: Mark J. McGee, 1107 Sunshine Ave., Brandon, Fla. 33511; Joel T. Hoffman, 613 Edgewood Dr., Nicholasville, Ky. 40356

[21] Appl. No.: 09/420,842

[22] Filed: Oct. 19, 1999

Related U.S. Application Data

[60] Provisional application No. 60/114,742, Jan. 4, 1999.

[51] Int. Cl.[7] ..... B65B 1/04

[52] U.S. Cl. ..... 141/299; 141/300

[58] Field of Search ..... 141/298–300, 141/331–345

[56] References Cited

U.S. PATENT DOCUMENTS

| | | | |
|---|---|---|---|
| 94,742 | 9/1869 | Hildebrand . | |
| 140,350 | 7/1873 | Crowther . | |
| 279,739 | 6/1883 | Gifford . | |
| 313,049 | 3/1885 | Bolus et al. . | |
| 357,476 | 2/1887 | Gersdorff . | |
| 955,553 | 4/1910 | Ritten . | |
| 1,705,312 | 3/1929 | Rovano . | |
| 1,938,138 | 12/1933 | Downs . | |
| 4,494,585 | 1/1985 | Waldecker | 141/98 |
| 5,277,234 | 1/1994 | Warstler | 141/299 |
| 5,787,944 | 8/1998 | Sarkus et al. | 141/300 |

*Primary Examiner*—Steven O. Douglas
*Attorney, Agent, or Firm*—Richard C. Litman

[57] ABSTRACT

A funnel assembly which includes an interior funnel and an exterior funnel. When an interior funnel is inserted into the exterior funnel, three equally spaced raised projections prevent contact between the outer surface of the interior funnel and the inner surface of the exterior funnel. This arrangement creates air passages between the two funnels for the venting of displaced air. Consequently, the liquid being poured runs faster into a container, unaffected by the upward movement of the vented air. The interior and exterior funnels are individually, integrally formed and come together as the exterior funnel is snapped into place next to the interior funnel by three wedges protruding on the outside spout of the interior funnel. These wedges are forced against the spout of the exterior funnel and hold the two funnels equidistant to each other.

5 Claims, 4 Drawing Sheets

EASY-FLOW FUNNEL

CROSS-REFERENCE TO RELATED APPLICATION

This application claims the benefit of U.S. Provisional Patent Application Ser. No. 60/114,742, filed Jan. 4, 1999.

BACKGROUND OF THE INVENTION

1. FIELD OF THE INVENTION

The present invention relates to funnels and is an easy-flow funnel assembly adapted for venting displaced air from a container being filled with liquid, thereby allowing the liquid to run faster into the container through the central spout of the funnel assembly.

2. DESCRIPTION OF RELATED ART

The use of funnels to pour liquids and other fluid substances is well-known and established in the related art. For example, U.S. Pat. No. 4,494,585 issued to Waldecker outlines a funnel that includes a ventilation subassembly. The ventilation subassembly includes a large ventilating passage that communicates with the interior of the container being filled and an angled pipe section. The angled pipe section is interconnected to a flexible conduit that runs outside of the funnel. The conduit is routed back to the open mouth of the funnel so it discharges downwardly into the funnel's mouth and beneath a baffle. Thus, the air being vented, as well as any fluid, passes through the angled pipe section, into the flexible conduit, and is discharged from the flexible conduit back into the funnel's mouth. Although this is a self-ventilating funnel, it is bulky and cumbersome to use. Also the flow area available for venting is limited by the size of the conduit and the angled pipe section.

U.S. Pat. No. 5,277,234 issued to Warstler outlines a self-ventilating funnel that is less bulky and cumbersome to use. The funnel includes a plurality of spaced and channelled depressions formed on the outside surface of the funnel. These depressions are arranged so the air is vented from the container up along the outside surface of the funnel. This funnel is provided with a flapper valve arrangement in the guide conduit portion to prevent overfilling of the container. However, because the depressions are on the outside surface, there is no other means for preventing unwanted spillage of material from an overflowing container. In other words, one cannot establish a leak tight connection between the funnel and the container being filled.

While some of the foregoing related art funnels include some mechanism for self-ventilating, there is a need for a self-ventilating funnel that is simple in design and usage, which minimizes or avoids unwanted spillage. It is also desirous for the self-ventilating funnel to allow the fill operation to be performed by one person.

None of the above inventions and patents, taken either singly or in combination, is seen to describe the instant invention as claimed.

SUMMARY OF THE INVENTION

The funnel assembly includes an exterior funnel and an interior funnel. When the interior funnel is inserted into the exterior funnel, three equally spaced raised projections prevent contact between the outer surface of the interior funnel and the inner surface of the exterior funnel. This arrangement creates air passages between the two funnels through which displaced air is vented. Consequently, the liquid being poured runs faster into the container, unaffected by the upward movement of the vented air. The interior and exterior funnels are individually, integrally formed and come together as the exterior funnel is snapped into place about to the interior funnel. Three wedges protruding on the outside spout of the interior funnel are forced against the spout of the exterior funnel and hold the two funnels equidistant to each other.

Accordingly, it is a principal object of the invention to provide an easy-flow funnel assembly adapted for venting displaced air from a container being filled with liquid, thereby allowing the liquid to run faster into the container through the spout of the funnel assembly.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
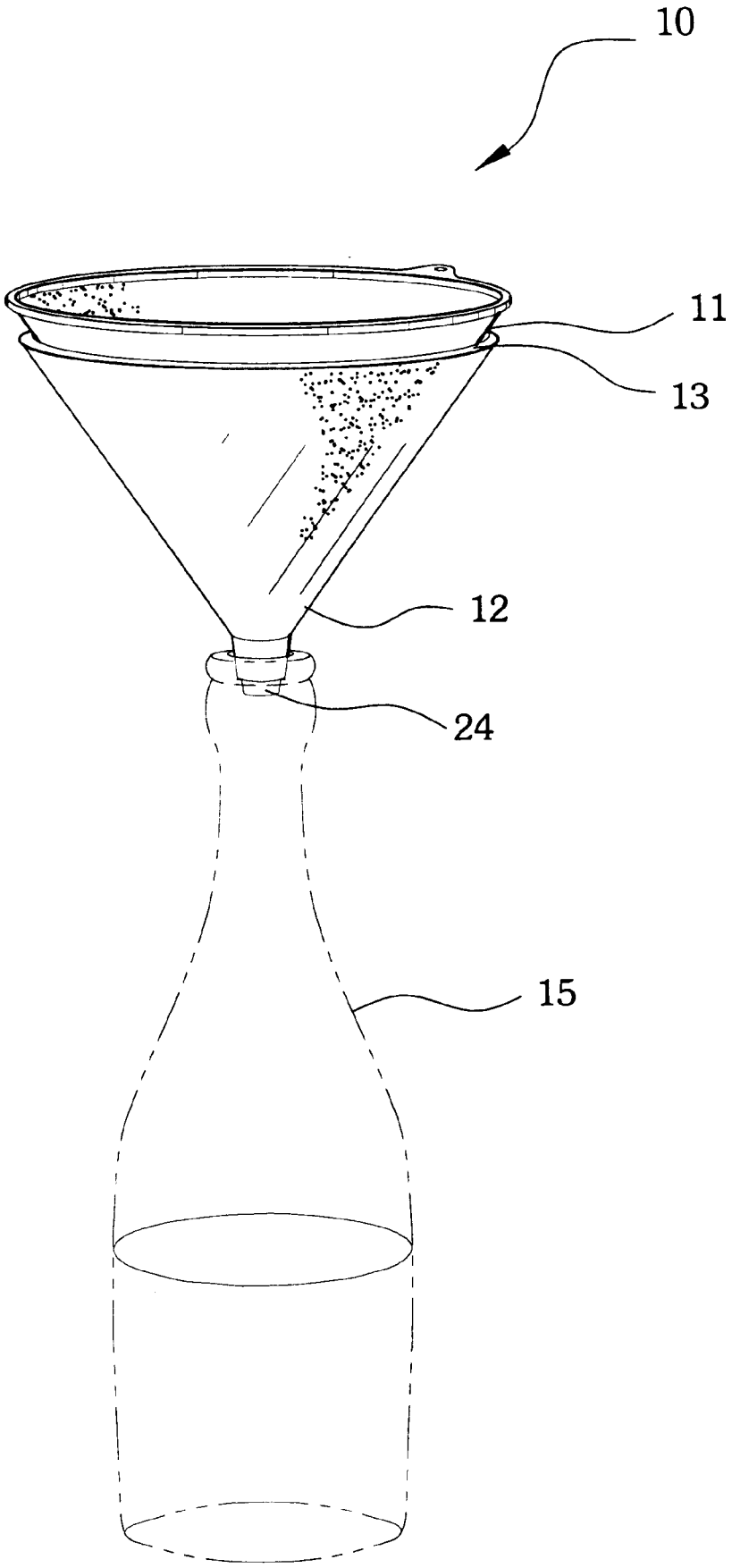
FIG. 1 is an environmental, perspective view of an easy-flow funnel according to the present invention.

The present invention is a self-venting apparatus 10 made up of an interior funnel 11 and an exterior funnel 12, as shown in FIG. 1. As best appreciated from FIG. 4, the spout 22 of the exterior funnel 12 has a larger inner diameter than the outer diameter of the spout 20 of the interior funnel 11. The interior funnel 11 is inserted inside the exterior funnel 12, being dimensioned so that a terminal portion 24 of the interior funnel 11 extends through the terminus 26 of the exterior funnel 12.

The interior funnel 11 has a plurality of equi-spaced raised projections 13 below the outside perimeter, whereby the interior funnel 11 and the exterior funnel 12 stay spaced to define a plurality of vent passages (See FIG. 4, items 16 and 17) between the two funnels. These raised projections 13 enable a flow of air coming up from the interior of the container 15 to pass between the sides of the two funnels.

Wedges 14 on the outside spout 20 of the interior funnel 11 are provided above the terminus of the interior funnel 11, where the exterior funnel 12 is secured in place in relation to the interior funnel 11. Thus, the self-venting apparatus 10 can also be taken apart, with the exterior funnel 12 being separated from the interior funnel 11 and used by itself to drain a thicker second liquid.

Figure 2:
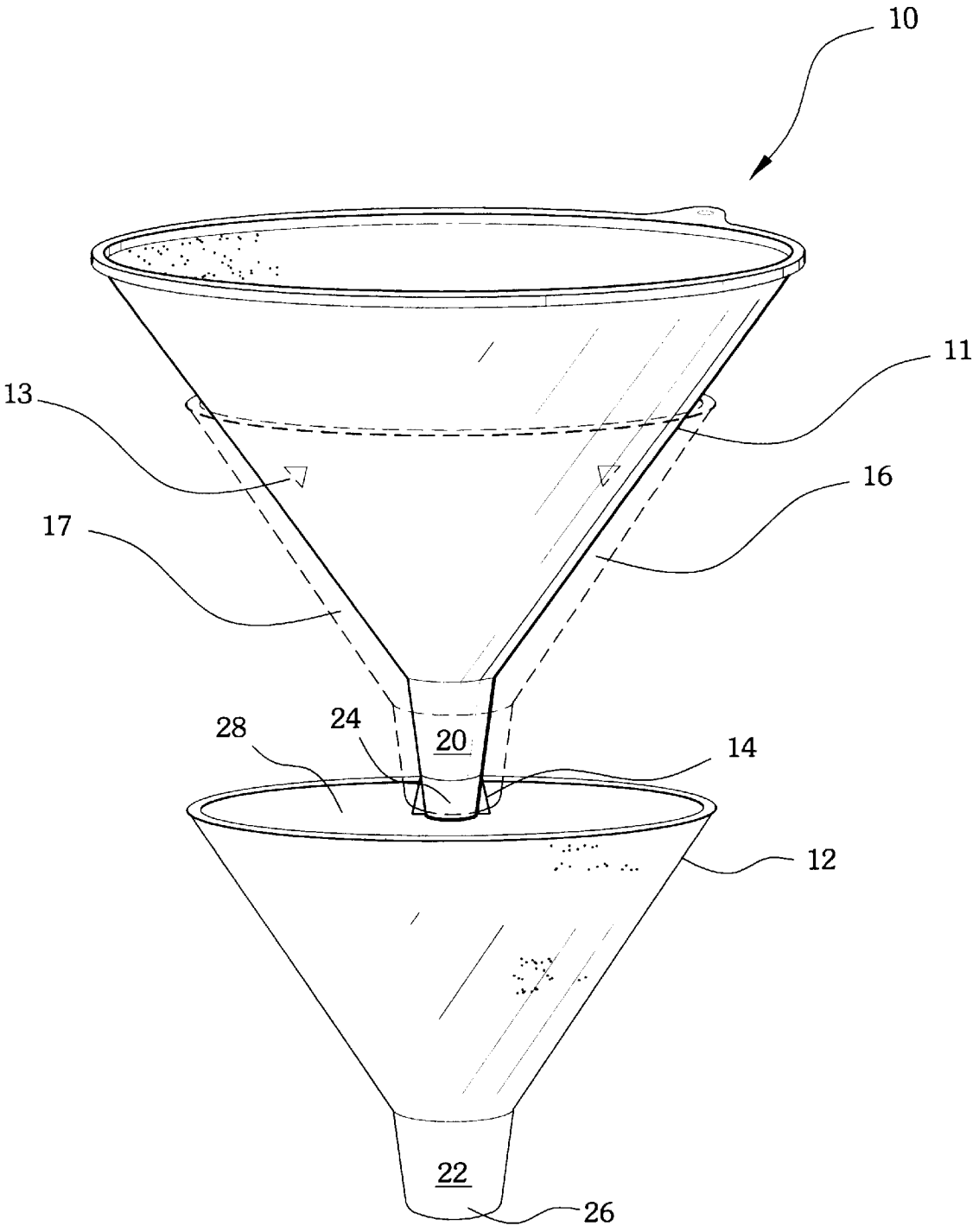
FIG. 2 is an exploded perspective view of the present invention.

An exploded environmental perspective view is provided in FIG. 2. This shows how the interior funnel 11 fits in the exterior funnel 12. The funnels nest in coplanar-surface relationship to each other, although the raised projections 13 on the outside perimeter of the interior funnel 11 space the exterior funnel 12 from contiguous contact with the interior funnel 11. The raised projections 13 allow the vent passages 16 and 17 to be formed between the two funnels, which allows air to flow up through the vent passages 16 and 17.

Figure 3:
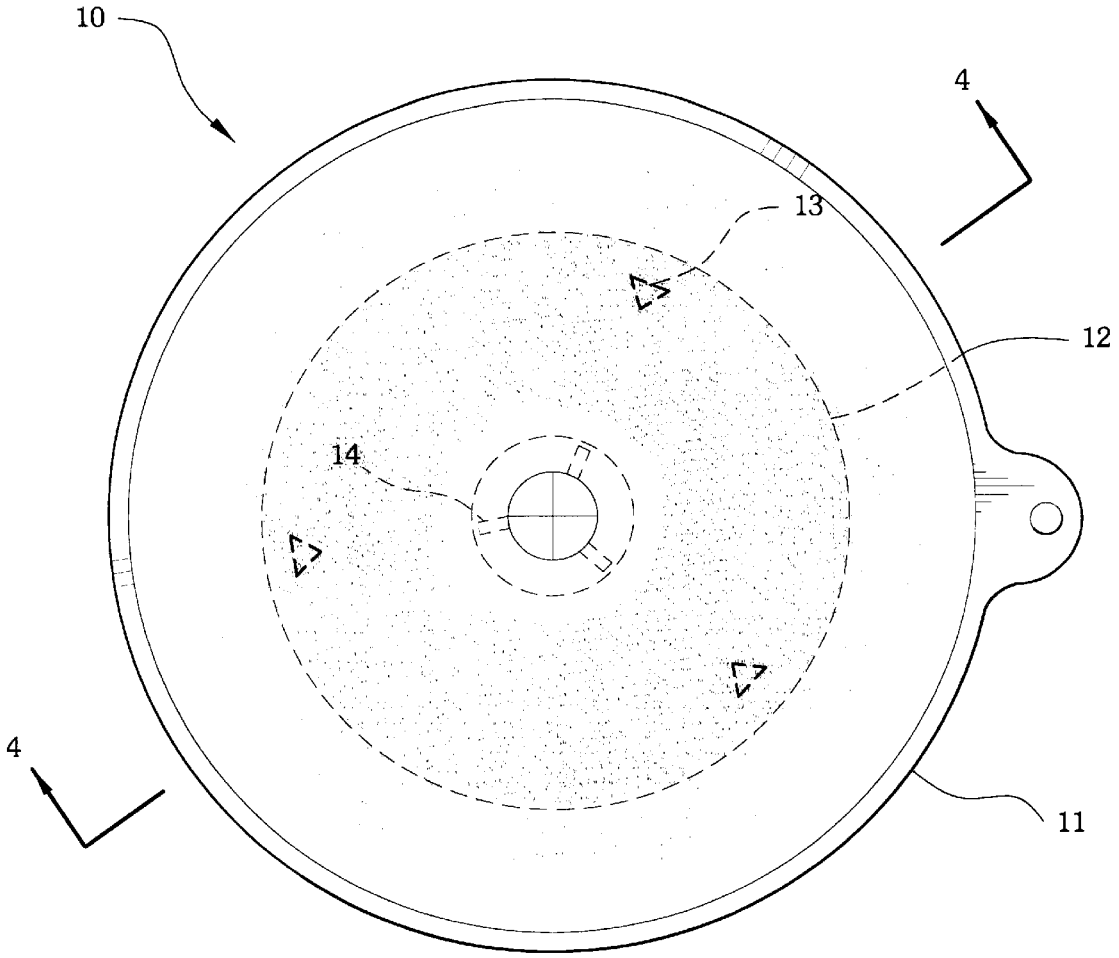
FIG. 3 is an top, plan view of the present invention.

An overhead view of the interior funnel 11 is provided in FIG. 3. This view shows in phantom line the raised projections 13, wedges 14 and exterior funnel 12 of the self-venting apparatus 10, and emphasizes that the liquid being poured will only come in contact with the interior funnel 11 when poured therein.

Figure 4:
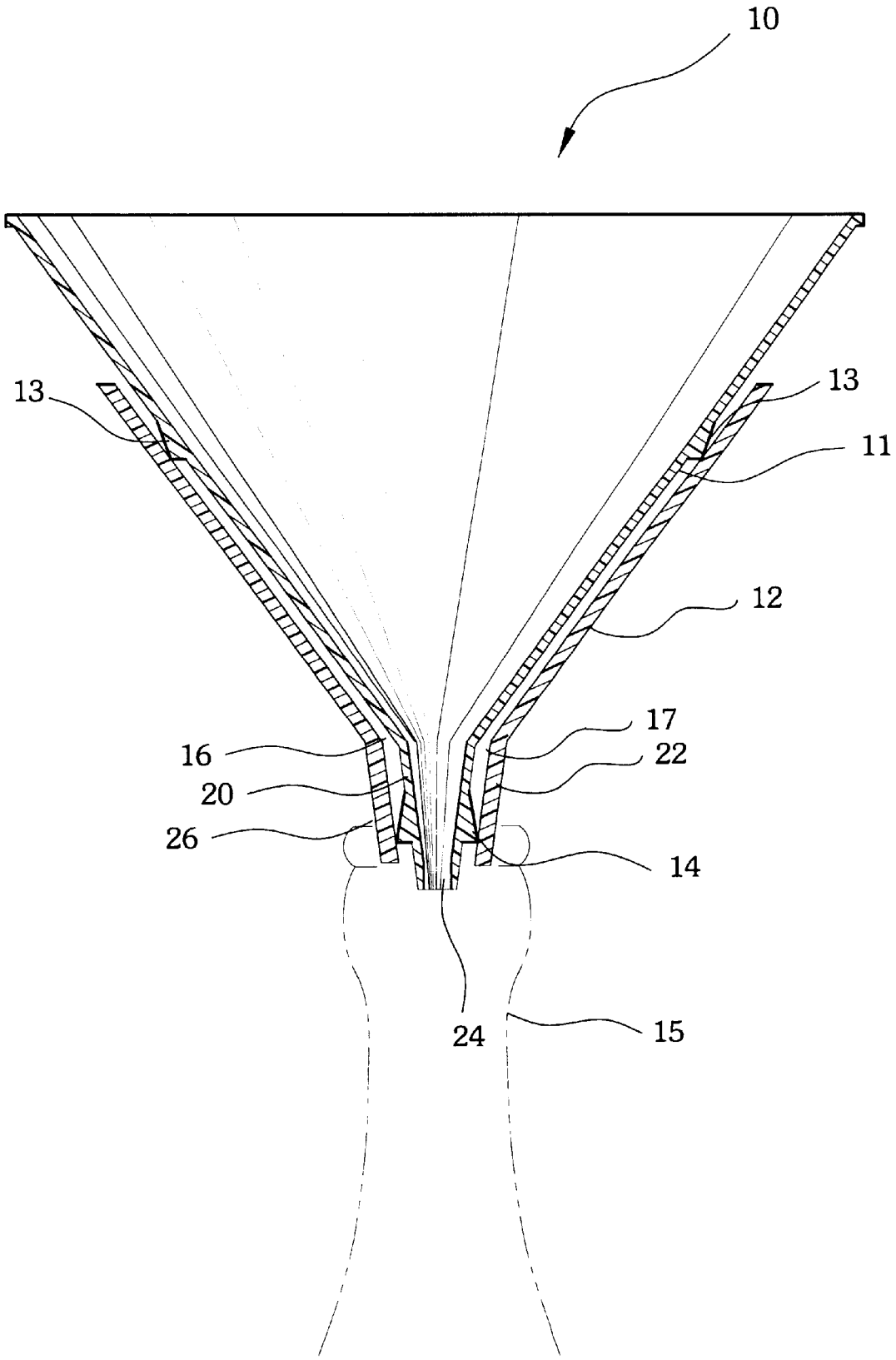
FIG. 4 is a cross-sectional view of the present invention taken along lines 4—4 of FIG. 3.

In FIG. 4, a cross sectional view is provided and shows the vent passages 16 and 17. These vent passages 16 and 17 are generally annular and surround the area between the two funnels. Moreover, it can be seen that the wedges 14 are integrally attached to the outside of the spout 20 of the interior funnel 11. The wedges 14 fill-in parts of the vent passages 16,17 and exert pressure against the inside spout 22 wall of the exterior funnel 12. There is still plenty of space left in the vent passages 16,17 to allow air to flow through the vent passages 16,17. The spout 20 of the interior funnel 11 can be pushed down into and through the spout 22 of the exterior funnel 12, until the two funnels are snapped together in place. A hose ring (not shown) for a hose adapter can also be attached to the apex of the interior funnel 11.

It is to be understood that the present invention is not limited to the sole embodiment described above, but encompasses any and all embodiments within the scope of the following claims.

We claim:

1. A self-venting funnel assembly comprising:

an interior funnel with an apex and an exterior funnel with an apex, the inside diameter of the exterior funnel being larger than the outer diameter of the interior funnel;

the interior funnel having a plurality of equally spaced projections around the outside perimeter below the top opening, wherein the interior funnel and the exterior funnel are spaced to define a plurality of vent passages therebetween;

a predetermined number of wedges being provided near the outside apex of the interior funnel, wherein the exterior funnel is secured in place in relation to the interior funnel;

wherein, in assembly, the interior funnel is inserted inside the exterior funnel, and the apex of the interior funnel is placed through the apex of the exterior funnel, thus to form said self-venting funnel assembly.

2. The self-venting funnel assembly according to claim 1, wherein air flow passages are defined between the interior and exterior funnels.

3. The self-venting funnel assembly according to claim 1, wherein the vent passages are circular in cross section.

4. The self-venting funnel assembly according to claim 1, wherein said funnels are constructed such that the exterior funnel is separable from the interior funnel.

5. The self-venting funnel assembly according to claim 1, wherein both of said funnels are fabricated from a plastics material.

* * * * *